United States Patent [19]

Erdos et al.

[11] 4,362,193

[45] Dec. 7, 1982

[54] INFLATING APPARATUS FOR PLAYBALLS

[75] Inventors: William A. Erdos, Peninsula; Edward J. Stropkay, Chesterland, both of Ohio

[73] Assignee: Eagle Rubber Co., Inc., Ashland, Ohio

[21] Appl. No.: 185,288

[22] Filed: Sep. 8, 1980

[51] Int. Cl.[3] ..... B65B 31/00; B65B 3/28

[52] U.S. Cl. ..... 141/94; 33/143 M; 33/178 R; 141/114; 141/197; 141/329; 141/351

[58] Field of Search ..... 33/143 M, 143 J, 148 E, 33/148 F, 178 R; 53/403; 116/DIG. 8, DIG. 9; 137/227; 141/1, 4, 94, 114, 192, 197, 317, 329, 351, 360, 361, 362

[56] References Cited

U.S. PATENT DOCUMENTS

| | | | |
|---|---|---|---|
| 1,768,327 | 6/1930 | Nichols | 141/197 X |
| 2,497,236 | 2/1950 | Polk . | |
| 2,668,359 | 2/1954 | Litchfield | 33/143 M |
| 2,926,705 | 3/1960 | Dorn . | |
| 3,932,977 | 1/1976 | Ringler . | |
| 4,165,770 | 8/1979 | Goldman | 141/329 |

*Primary Examiner*—Frederick R. Schmidt
*Attorney, Agent, or Firm*—Gravely, Lieder & Woodruff

[57] ABSTRACT

Inflation apparatus for hollow flexible wall objects, such as playballs, in which the source of inflation gas or air is normally inoperative until the object to be inflated is moved into engagement with a gas injection needle for energizing the source of inflation gas, and the source of inflation gas is returned to its normally inoperative state upon the object reaching its desired inflated size. Upon the removal of the inflated object the apparatus is returned to a condition where a subsequent object to be inflated can be supplied with the inflation gas.

6 Claims, 2 Drawing Figures

INFLATING APPARATUS FOR PLAYBALLS

BACKGROUND OF THE INVENTION

1. Field of the Invention

This invention is directed to apparatus for inflating playballs at the point of sale or distribution and is particularly arranged to be a substantially self-contained assembly requiring only an outside source of power for the pump motor. 2. Description of the Prior Art It is known that playballs, as well as other types of balls may be inflated either when manufactured, or at the time when they are sold or put into use. It is also known to provide means for gauging the size of a playball upon being inflated. Certain features of the prior art are found in Ringler U.S. Pat. No. 3,932,977 of Jan. 20, 1976; Polk U.S. Pat. No. 2,497,236 of Feb. 14, 1950; and Dorn U.S. Pat. No. 2,926,705 of Mar. 1, 1960.

In the disclosure by Ringler, the apparatus is very complicated and is used by a ball manufacturer to inflate and plug a ball prior to delivery to a point of sale or use. One of the complications is that the ball needs to be heated for proper inflation. Another complication is that an external air supply is required, and the control over inflation relies upon relays, solenoid valves and limit switches in a circuit which does not shut off the compressor supplying the air. In Polk, the device is merely a go-no-go size gauge for comparing a workpiece with a known standard size. The apparatus of Dorn is directed to making inflatable hollow articles in a preliminary forming step and then in a final formation using the inflation needle to inject sealing fluid concurrently with pushing the article off the needle. The latter operation occurs upon the article reaching a size to break a light beam.

The problem with the foregoing early devices is that they are complicated to the point where they are not suitable for use at the point of sale or distribution or are not acceptable in a retail store for use by the usual sales people because of complicated steps in the operation; or the initial cost is excessive, or both these combine to fail to build acceptance.

SUMMARY OF THE INVENTION

The present inflating apparatus for playballs overcomes the problems found in the prior art, which are to reduce cost of apparatus, make the operation uncomplicated, and insure its utility so that the inflation of playballs can be accomplished as needed and at the point of sale or distribution.

The preferred embodiment is directed to a self-contained inflation apparatus having simple and safe to operate controls for use in the inflation of many different types of playballs having a self-closing inlet, or an inlet which requires a removable plug for retaining the air. The apparatus is provided with means for gauging the playball size, automatically stopping the pump when the size set by the gauge has been reached, and means to start the pump only after the playball is in proper position on the inflation needle.

The objects of the present invention are to provide playball inflation apparatus for use at the point of sale of the playballs, to have inflation apparatus of simple and easy to operate construction, one in which different sizes of playballs may be inflated, one in which the playballs are not inflated until desired to save storage space and shipping problems usually associated with inflation-type balls.

A more specific object of the present invention is to provide inflation apparatus for operation when a playball needs to be inflated or reinflated, thereby reducing storage space problems, and enabling longer shelf-life by permitting correction of shrinkage that may occur.

Other objects will appear from the following description.

BRIEF DESCRIPTION OF THE DRAWINGS

Reference will be directed to the details of the inflation apparatus shown in the accompanying drawings, wherein.

DETAIL DESCRIPTION OF THE PREFERRED EMBODIMENT

Figure 1:
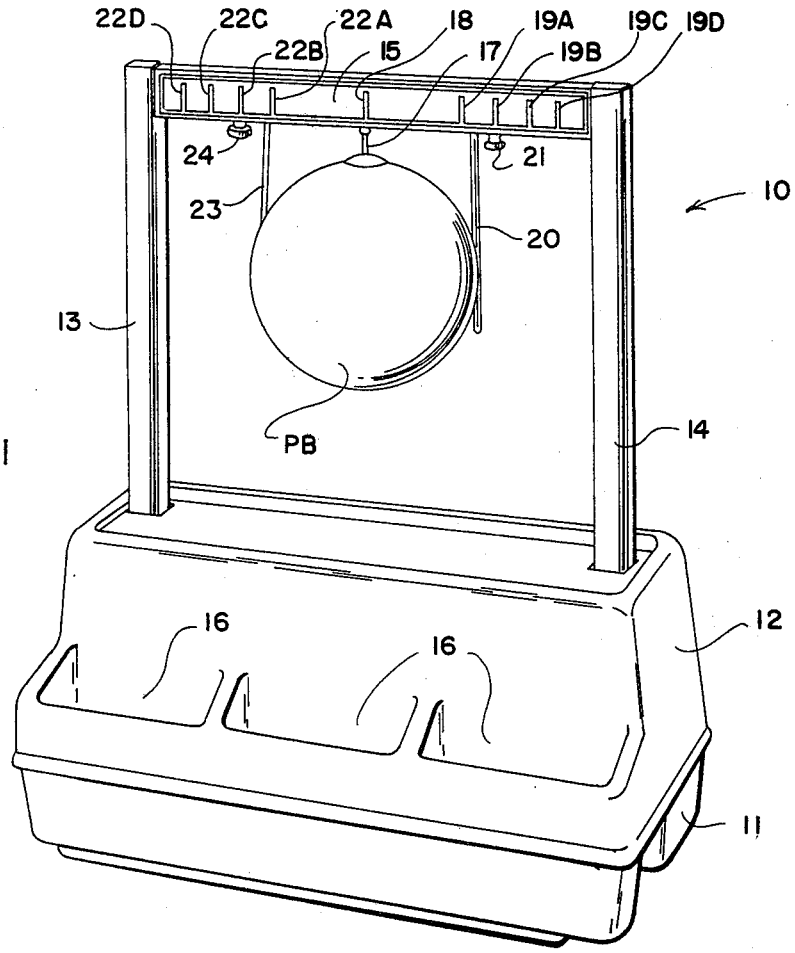
FIG. 1 is a perspective view of the apparatus as seen from the front.

The present apparatus 10 is shown in assembly in FIG. 1, and comprises a base having a lower part 11 and a cover part 12 for enclosing a drive motor and an air compressor to be referred to presently. A pair of vertical supports 13 and 14 of hollow tubular character extend from the base and are interconnected by a horizontal support 15. The cover part 12 may be formed with tray compartments 16 for holding safety glasses, plugs and plug inserting means.

The horiozntal support 15 carries near its mid-length an inflation needle 17 which is indicated by the indicia 18 and legend "INFLATION NEEDLE". At the right of the needle location, the support 15 is provided with playball diameter size indicia 19A, 19B, 19C and 19D, and a non-pivoted but horizontally movable arm 20 is mounted so as to depend from the support. The arm 20 can be secured in position by a clamp means having an operating knob 21 associated therewith. To the left of the needle, the support 15 is provided with size indicia 22A, 22B, 22C and 22D, these indicia being related in proper size diminsions with the indicaia 19A to 19D respectively. For example, a small playball diameter can be selected by using the innermost indicia at each side of the needle 17, while the largest diameter can be selected by using the indicia farthest from the needle 17. The horizontally movable arm 20 does not pivot or swing so acts as a stop. In contrast, a second arm 23 is mounted from the support an is arranged to both slide horizontally relative to the support 15 and pivot so it can swing away from the stop arm 20. Clamping means for fixing the horizontal location of the arm 23 is operated by a knob 24.

Figure 2:
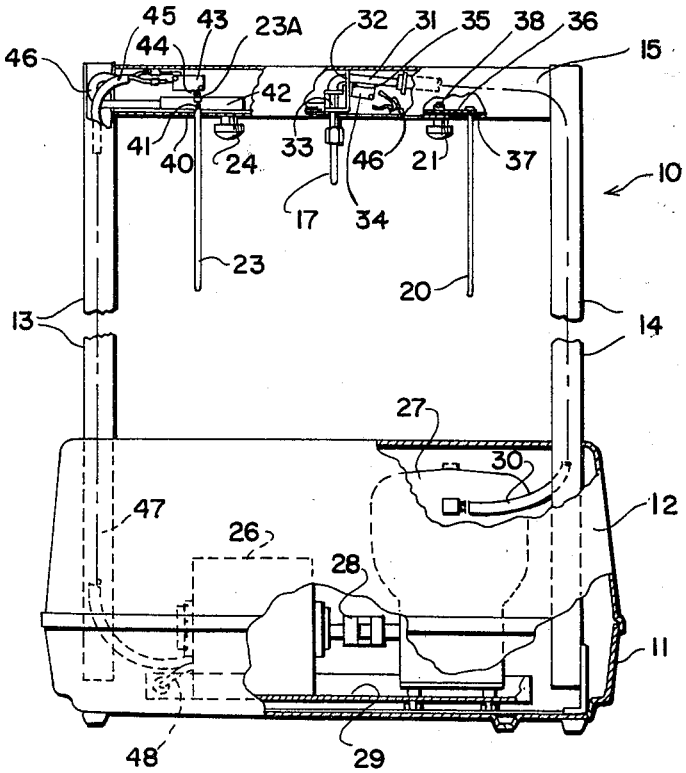
FIG. 2 is a fragmentary sectional elevational view, on an enlarged scale, of the apparatus seen in FIG. 1.

Referring now to FIG. 2, the lower base part 11 carries an electric motor 26 and an air compressor 27. These components are connected through a flexible coupling 28. A vibration support plate 29 is provided for those operating components, and the cover part 12 encloses the assembly.

The compressor 27 has a flexible air outlet hose 30 which is extended through the hollow vertical support 14 to enter the horizontal support 15. The upper end of the hose 30 is connected to an elbow fitting 31 stabilized in position by a guide bracket 32 such that the elbow can move in a vertical path, and is normally resting on the flange 32 of the bracket by its own weight. The bracket flange 33 has a hole to receive the fitting and allow it to move in a substantially vertical direction if an upward force is applid on the needle 17. A microswitch 34 is carried by the bracket 31 with its switch button 35 positioned to be depressed for normally holding the microswitch 35 in its circit-open position.

Still referring to FIG. 2, the movable but non-pivotal arm 20 is fastened to a slide plate 36 so it can pass through a slot 37 in the underside of the support 15. The knob 21 is formed with a threaded shaft 38 which engages in a threaded aperture in slide plate 37. The knob can be tightened to hold slide plate in adjusted position at any one of the indicia 19A to 19D, or at an intermediate location. The cooperating arm 23 at the left of the needle 17 depends through a slot 40 in support 15 from a pivot 41 carried in a bracket 42. The knob 24 is, like knob 21, arranged to have its threaded shaft (not seen) draw the bracket 42 arranged the support 15 when it is desired to locate the arm 23 opposite any of the indicia 2A to 22D or at some intermediate location to substantially match the same location for arm 20. Symmetry of location of arms 20 and 23 relative to needle 17 is not always necessary, depending on the object being inflated. The bracket 42 carries a microswitch 43 with its actuating button 44 directed downwardly so that the upwardly extending nose 23A of the arm can normally hold button 44 in a circuit-make position. The weight of arm 23 is such that it will normally hang straight down, but it can be swung about the pivot 41 so as to break contact with button 44 and allow the microswitch to open its contacts. An electrical wiring lead 45 from microswitch 43 and a lead 46 from microswitch 34 are combined in an electrical cable 47 which is extended through the hollow support 13 to motor 26. A suitable power supply cord 48 enters the lower base 11 to supply the electric power for the motor 26 and microswitches 34 and 43. However, no current is applied to motor 26 until the needle 17 is raised to allow microswitch 34 to close circuit, and the motor 26 is stopped by pivoting arm 23 leftwardly or clockwise about pivot 41 to open the circuit at microswitch 43.

Operation of the device is as follows, it being understood that in the normal non-use position, electrical power can be supplied to the motor 26, but the air compressor 27 will not operate because the rigid tube 31 is down to normally open microswitch 34, and pivotal arm 23 is vertically positioned so as to position microswitch 43 in its normally closed position. Power supplied to the drive motor 26 can be obtained by lifting the inflation needle 17 upwardly to permit microswitch 34 to move to the closed or power-on position. At this time the power circuit will be made through the normally closed microswitch 43. A deflated playball PB must be pushed onto the needle 17 and this raises the rigid tube 31 to permit closing of the microswitch 34. The air compressor will be operated to supply air through the flexible tube 30, and the playball PB during its inflation should be held along the center axis of the needle 17 so as to be approximately equal distance from the arms 20 and 23. The playball PB will continue to inflate until it reaches the size effective to push the pivotal arm 23 in a direction to open microswitch 43 and cut off power to the drive motor 26. The removal of the playball will cause the needle 17 to be pulled down dragging the rigid tube 31 to a position for returning the microswtich 34 to its normally open position. Furthermore, removal of the inflated playball will permit the pivotal arm 23 to be returned to its starting position so that microswitch 43 can return to its normally closed position.

It is to be understood that the arms 20 and 23 need to be adjusted along the horizontal support 15 to selected positions, using the indicia 19A to 19D and 22A to 22D as guides for the size of playball PB to be inflated. Clamp knobs 21 and 24 fix the selected positions. The current to motor 26 is turned on, and a deflated playball PB is brought to needle 17 so its air inlet can be forced over the needle, thereby raising the needle and closing the circuit in microswitch 34 to energize the motor 26.

When the playball PB has reached its desired inflation size it will pivot arm 23 to open microswitch 43 and stop motor 26. During the inflation period the playball PB is held up to keep microswitch 34 closed, and when inflation is completed pulling the playball PB off needle 17 will open microswitch 34. A plug is inserted in the air inlet to the playball PB to retain the air.

The circuits for the microswitches 34 and 43 are arranged such that the operation of microswitch 34 is primarily for starting and stopping the flow of inflating gas, such as controlling the compressor motor 26. Thus, an inflatable object can be pushed onto the needle 17 and partly inflated and removed before it engages the arm 23. On the other hand, the size of the object can be allowed to increase until it pivots the arm 23 to actuate microswitch 43 which overrides the microswitch 34 to stop the flow of inflating gas.

The present apparatus can be used for initial inflation purposes, or for reinflation of a playball. Normally the playball should be at room temperature so that its material will be pliable to stretch as needed during inflation. Experience will show that for some playballs a slight under inflation is best as the inflation causes a certain "growth" to take place. Plugging may not be needed when the playball has a self-sealing air inlet fitting. While air is used in the above description, it is understood that any gases for inflating playballs, and other inflatable objects, are to be included in that term.

What is claimed is:

1. Inflation apparatus for inflating playballs to predetermined size comprising:

(a) a frame providing a generally horizontal support having a first indicia and playball size indicia spaced apart at opposite sides of said first indicia for denoting playball size increments;

(b) inflator means carried by said frame in position indicated by said first indicia to receive a playball for inflation;

(c) playball size determining means carried by said frame support and selectively movable along said frame support, and including means fixing the spacially separated and adjusted positions of said size determining means for predetermining the final inflated size of the playball prior to being inflated;

(d) a source of inflating gas connected to said inflator means;

(e) first control means carried by said frame and initially operable upon a playball received on said inflator means for admitting the gas from said source for inflating the playball to a size for engaging said size determining means; and (f) second control means for stopping the admission of gas upon the playball engaging said size determining means.

2. The apparatus set forth in claim 1 wherein said inflator means is a needle and is supported for axial movement relative to said frame, and said first control means operable for admitting gas from said source is responsive to axial movement of said needle in receiving a playball.

3. The apparatus set forth in claim 1 wherein said size determining means comprise a first arm manually slidable along said frame to a predetermined position spaced from said inflator means and a second arm also manually slidable along said frame to a predetermined position spaced from said inflator means and further swingable into a position for stopping admission of gas to complete the playball inflation, the predetermined position of said first and second arms being on opposite sides of said inflator means.

4. The apparatus set forth in claim 1 wherein said source of inflating gas comprises a motor operated compressor, said first control means comprises a first switch responsive to axial movement of said inflator means for energizing said motor operated compressor to deliver gas through said inflator means, and said second control means comprises a second switch responsive to the inflating response to the playball engaging said size determining means for stopping energization of said motor operated compressor.

5. The apparatus set forth in claim 4 wherein said size determining means are elongated arms normally substantially parallel with said elongated needle and spaced to receive a playball therebetween, one of said arms being pivotally movable to operate said second switch.

6. The apparatus set forth in claim 1 wherein said first control means includes a first normally open circuit switch operably responsive to a playball received on said inflator means for moving to circuit closing position to initiating the admission of the inflating gas, and said second control means is a normally closed switch operable upon a playball engaging said size determining means for stopping the admission of the inflating gas, whereby removal of the inflated playball from said inflator means returns said first switch to normally open position and said second switch to normally closed position, and said source of inflating gas is a motor operated compressor connected in circuit with said first and second switches.

* * * * *

UNITED STATES PATENT AND TRADEMARK OFFICE

CERTIFICATE OF CORRECTION

PATENT NO. : 4,362,193

DATED : December 7, 1982

INVENTOR(S) : William A. Erdos and Edward J. Stropkay

It is certified that error appears in the above-identified patent and that said Letters Patent is hereby corrected as shown below:

Column 3, line 16, delete "arranged" and insert "against"

Column 3, line 18, delete "2A"and insert "22A"

Column 5, line 22, delte "to" and insert "of"

Signed and Sealed this

*Eighth* Day of *February 1983*

[SEAL]

*Attest:*

GERALD J MOSSINGHOFF

*Attesting Officer*

*Commissioner of Patents and Trademarks*